US007886919B2

(12) United States Patent
Battaglia, Jr. et al.

(10) Patent No.: US 7,886,919 B2
(45) Date of Patent: Feb. 15, 2011

(54) DISPLAY SHELVING MODIFICATION

(75) Inventors: Joseph Marcus Battaglia, Jr., Frisco, TX (US); Michael Robert Howley, McKinney, TX (US); Reggie Wayne Stubblefield, Garland, TX (US)

(73) Assignee: Frito-Lay North America, Inc., Plano, TX (US)

( * ) Notice: Subject to any disclaimer, the term of this patent is extended or adjusted under 35 U.S.C. 154(b) by 803 days.

(21) Appl. No.: 11/419,004

(22) Filed: May 18, 2006

(65) Prior Publication Data

US 2007/0267375 A1 Nov. 22, 2007

(51) Int. Cl.
*A47B 47/00* (2006.01)

(52) U.S. Cl. ..... 211/189; 211/187

(58) Field of Classification Search ..... 211/134, 211/135, 153, 186, 187, 189, 190, 193, 195, 211/106, 103, 207; 108/106–108
See application file for complete search history.

(56) References Cited

U.S. PATENT DOCUMENTS 3,263,821 A * 8/1966 Klene et al. ..... 211/190
3,556,023 A * 1/1971 Marschak ..... 108/1
3,640,389 A * 2/1972 Snyder ..... 211/187
3,669,036 A * 6/1972 Marschak ..... 108/157.13
4,646,656 A * 3/1987 Marschak ..... 108/108
4,785,946 A * 11/1988 Sorensen ..... 211/187
4,919,282 A * 4/1990 Duff et al. ..... 211/134
5,313,891 A * 5/1994 Suttles ..... 108/108
2006/0016774 A1 * 1/2006 Bustos ..... 211/186

OTHER PUBLICATIONS

"Display Shelving Components" by Lozier Corporation, found at http://www.lozier.com/mod5-ic.htm, dated Nov. 18, 2005.

* cited by examiner

*Primary Examiner*—Jennifer E. Novosad
(74) *Attorney, Agent, or Firm*—Colin P. Cahoon; Amanda K. Jenkins; Carstens & Cahoon, LLP

(57) ABSTRACT

A improved product display adaptable to standard gondola systems. The display increases the retail sales space available by providing for the recovery of unused space traditionally existing below the original base deck of the display. This display comprises a new free-standing base deck to replace the original base deck. The free-standing base deck positionally registers in the space where the original base deck was located. The free-standing base deck rests directly on the floor surface beneath the product display thus reclaiming the unused space beneath the original base deck. The display includes an additional member for maintaining the product display's base brackets parallel to assist in retaining and positionally registering the free-standing base deck, and an additional member for maintaining the aesthetic appearance of the product display's base brackets by covering the exposed portions that were once hidden by the original base deck.

12 Claims, 6 Drawing Sheets

DISPLAY SHELVING MODIFICATION

BACKGROUND OF THE INVENTION

1. Technical Field

The present invention relates generally to a display shelving system. More specifically, the invention relates to a modification to a retail sales display gondola that allows for the replacement of the standard base deck with a free-standing base deck. This modification can be made to numerous different gondola systems manufactured by different manufacturers, but accomplishes the same goal of adding shelf space to the gondola.

2. Description of Related Art

Retail display shelving commonly used in grocery stores, department stores, discount stores, and other retail outlets that display items on shelves, are manufactured by numerous companies in a plethora of models and design choices. The units that are typically found in a grocery store to display items for sale, such as bags of salty snacks, are typically referred to in the industry as gondola units. These units are typically self-contained with multiple shelves. A list of some of the manufacturers offering these gondolas includes Lozier, Madix, the Thorco Division of Marmon Group, and Syndic Systems Division of Legget and Platt.

Although there are variations amongst the gondola units offered by different manufacturing companies, the basic design is fairly well established and there are many common features shared industry wide. A typical example of a gondola system is illustrated in FIGS. 1A and 1B. The particular gondola system illustrated in these figures is manufactured by Lozier, but is illustrative of many others offered by other manufacturers. FIG. 1A presents an exploded perspective view of the basic components of the prior art while FIG. 1B shows a perspective view of an assembled unit as one would encounter in a retail environment.

The core of the prior art gondola is a back panel 102 which is vertically oriented and is held in position by connection to at least one upright 104, which is also vertically oriented. In the embodiment shown, the connection to the upright 104 is accomplished by at least a bottom rail 108, a center rail 110, and a top rail 122, although more of such horizontal rails 108, 110, and 122 can be used for this purpose. The vertical uprights 104 are stabilized by at least one, and typically two, base legs or brackets 106. One or more shelves 112 can be horizontally positioned in numerous locations relative to the back panel by virtue of connections between the shelf 112 and the uprights 104. A base deck or shelf 114 is maintained off of the surface upon which the entire unit sits by being supported by the base brackets 106. A closed base front 116 encloses the space beneath the base deck in conjunction with base deck 114 and base bracket trim 118, when said base and trim also covers the base brackets 106. The gondola unit may have other trim components such as the upright and trim 120 that covers the upright 104. A disadvantage of the gondola system illustrated in FIGS. 1A and 1B is that, since the base deck 114 is elevated off of the flooring to the approximate height of the base leg or bracket 106, the display space that could be used is limited by the displacement beneath. In certain applications, a modification to the system may be desired that positions the base deck as close as possible, and perhaps even resting on, the flooring. It would be desirable to have a single modification unit that could be used with a variety of gondola systems.

Nothing in the prior art addresses the problem associated with maximizing the available retail sales space on a typical gondola. Because retailers have a fixed amount of floor space with which to display retail merchandise, a need exists for a means to maximize the available space. A further need exists for a means to reclaim the retail sales space that is wasted below the bottom shelf of most gondolas. Because retailers typically utilize gondolas from multiple vendors, a further need exists for a means to maximize the retail shelving space that works universally with many different brands of gondolas. The present invention fills these needs and other needs as detailed more fully below.

BRIEF SUMMARY OF THE INVENTION

The preferred embodiment of the present invention provides a means for reclaiming wasted retail shelving space present in most typical retail display shelving systems (referred to in the industry as "gondolas"). The lower base deck of a typical gondola unit sits several inches above the floor surface. This space beneath the base deck is merely hidden and unutilized. The present invention comprises a free-standing base deck that replaces the fixed base deck, and is positioned entirely within the space that originally held the fixed base deck. This free-standing base deck aligns with the gondola's back panel and base brackets without physical attachments to the gondola. One embodiment of the present invention includes a stretcher device to serve as a means to couple with and maintain proper spacing of the gondola's base brackets, allowing the free-standing base deck to sit directly on the surface of the floor beneath the gondola.

One preferred embodiment of the present invention is made of the same or similar materials as the original base deck which it replaces. The preferred embodiment is metal, preferably 18 Ga. cold rolled steel, which affords the free-standing base deck sufficient durability to withstand the abuse of the retail sales environment. All other components are made of similar materials to ensure proper rigidity of the gondola structure as well as proper operation of the entire gondola unit.

The invention accordingly comprises the features described more fully below, and the scope of the invention will be indicated in the claims. Further objects of the present invention will become apparent in the following detailed description.

BRIEF DESCRIPTION OF THE DRAWINGS

The novel features characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

Like reference numerals represent equivalent parts throughout the several drawings.

REFERENCE NUMERALS

Figure 1A:
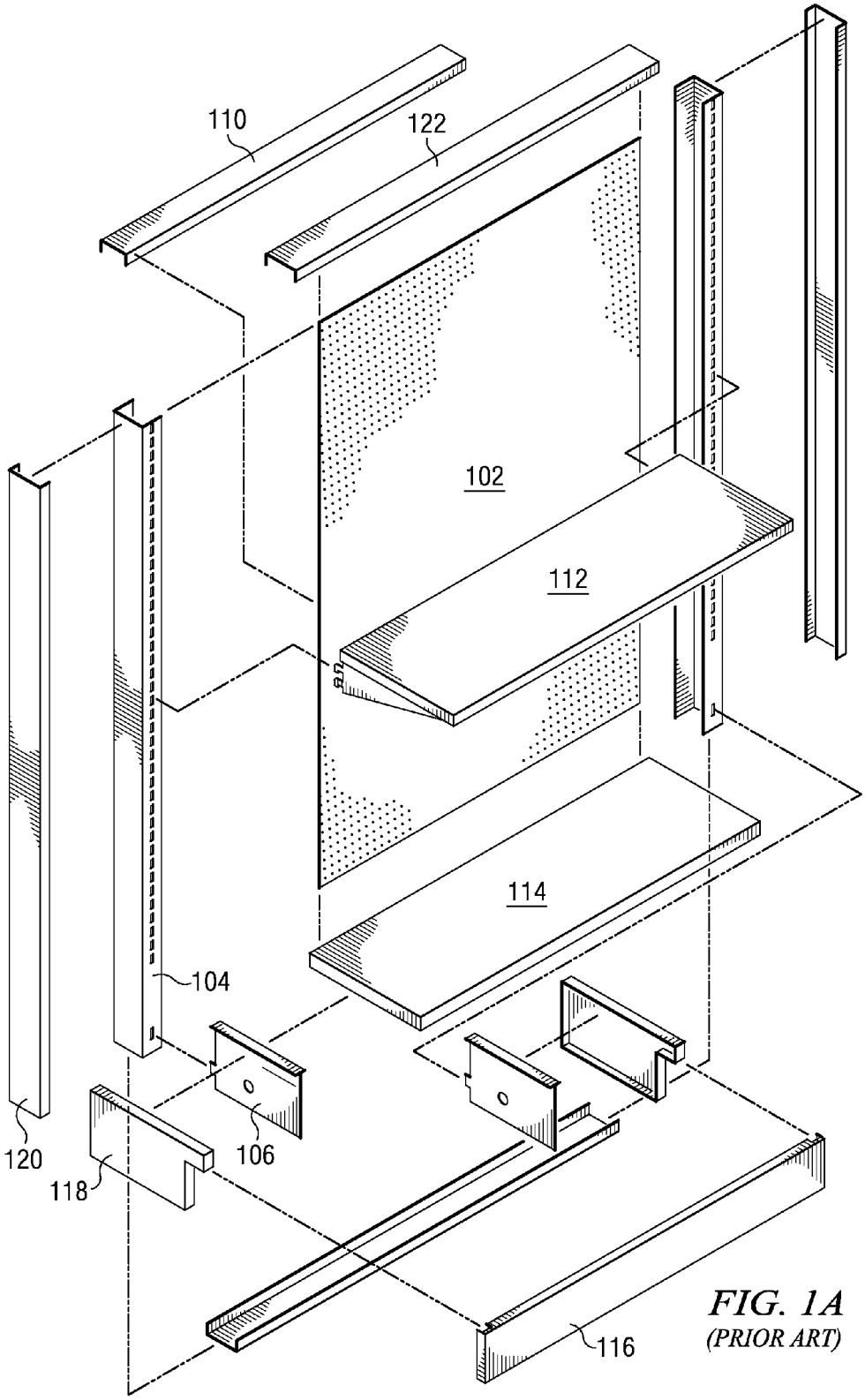
FIG. 1A (PRIOR ART)
FIG. 1A illustrates an exploded perspective view of a prior art design for a typical prior art retail display shelving or "gondola" unit.

102 back panel
104 upright
106 base bracket
108 bottom rail
110 center rail
112 shelf
114 base deck
116 base front
118 base bracket trim
120 upright end trim
122 top rail
202 free-standing base deck
204 stretcher
206 leg cap
304 spanner

DETAILED DESCRIPTION OF THE INVENTION

Figure 1B:
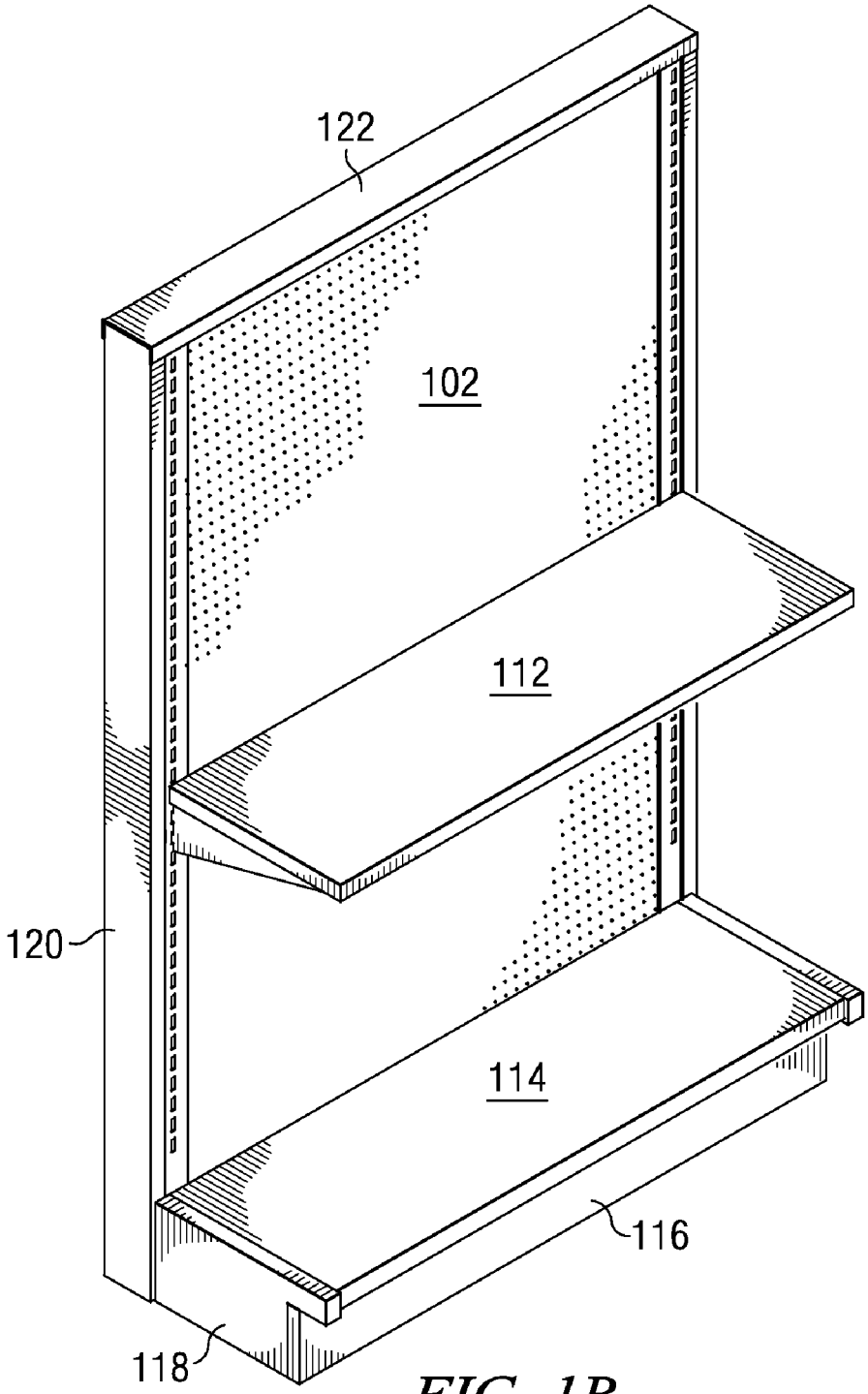
FIG. 1B (PRIOR ART)
FIG. 1B illustrates a perspective view of an assembled prior art design for a typical prior art retail display shelving or "gondola" unit as one would encounter in a typical retail sales establishment.
Figure 2A:
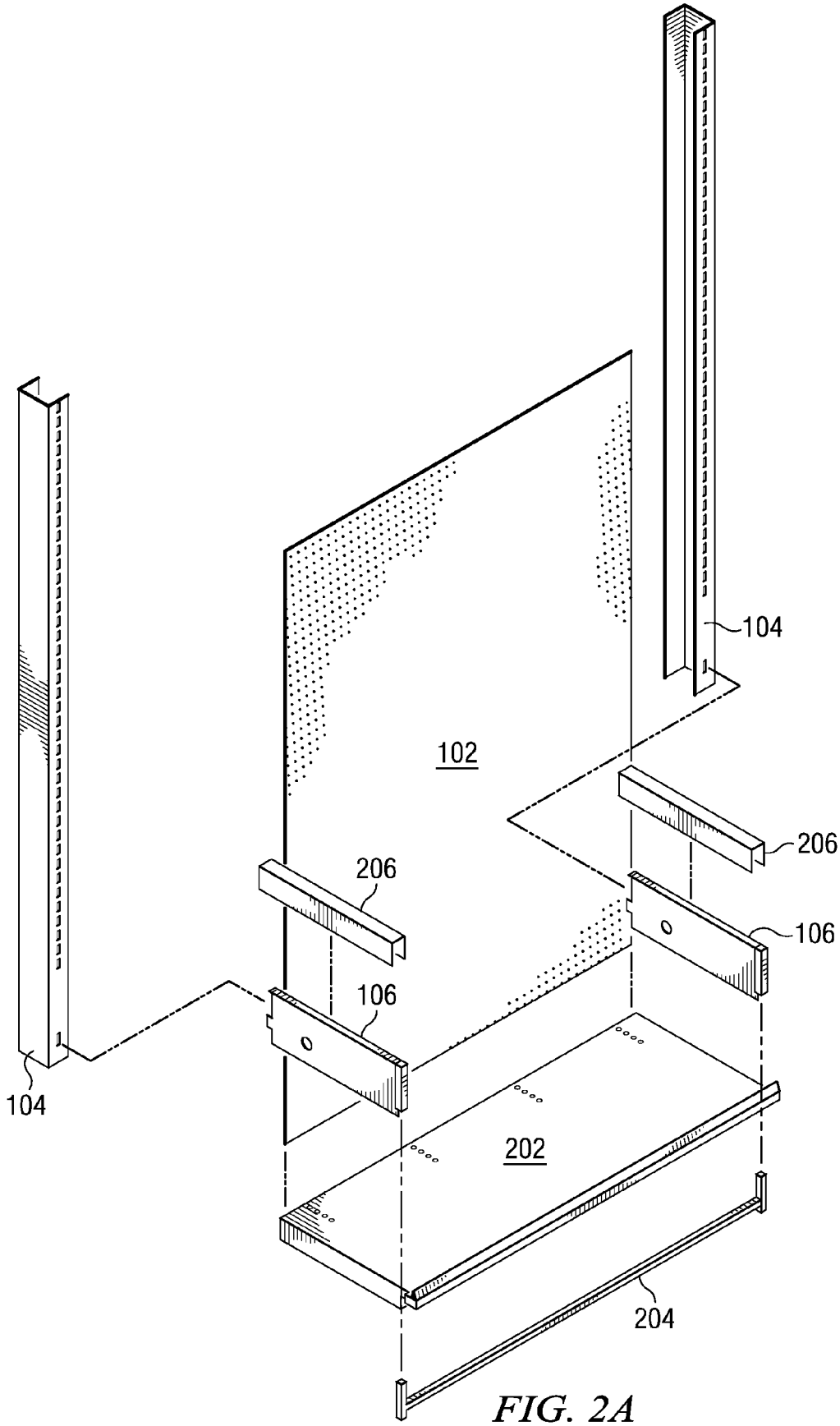
FIG. 2A illustrates an exploded perspective view of a first embodiment of the present invention utilizing a "stretcher" in conjunction with a typical gondola unit.
Figure 2B:
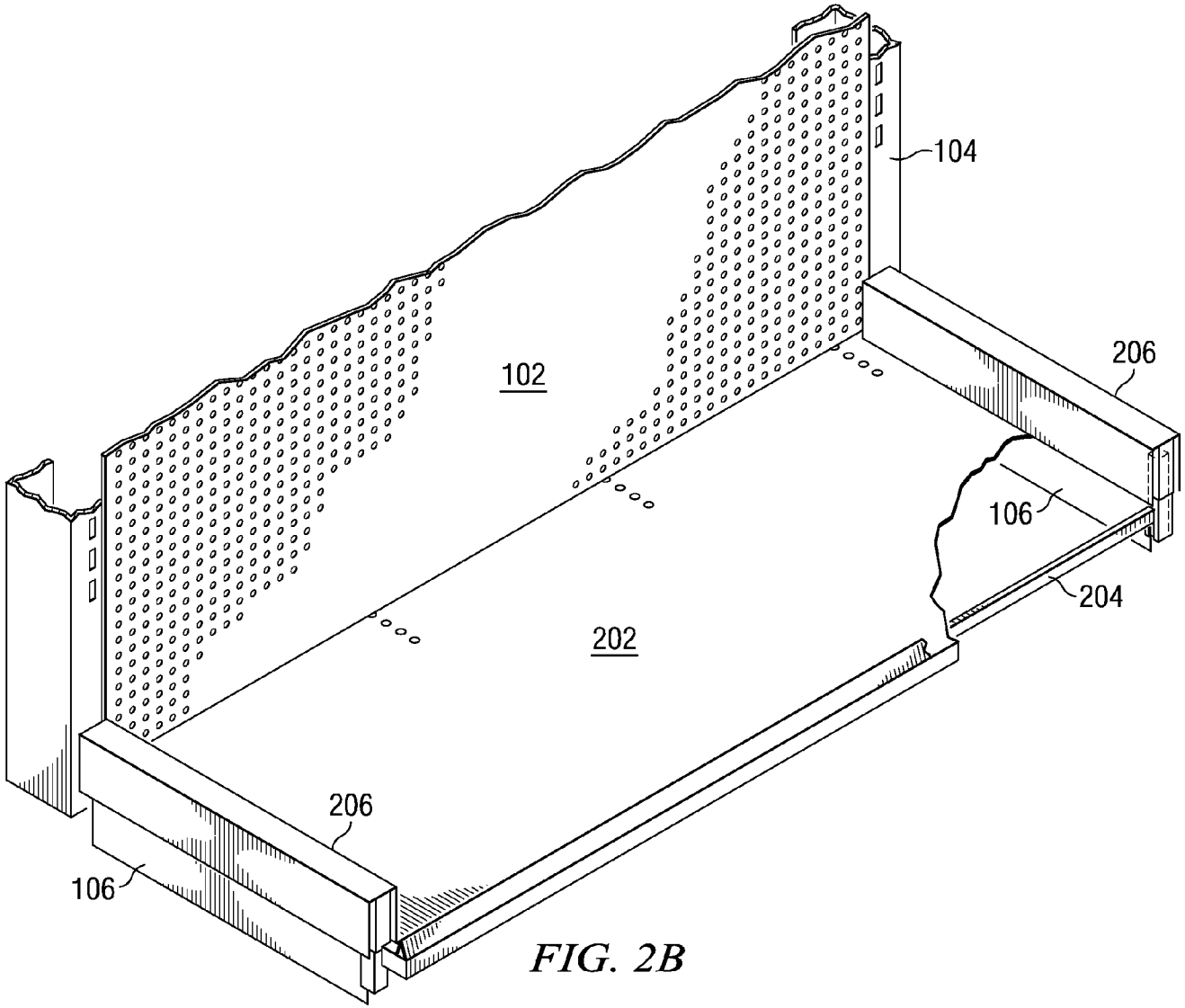
FIG. 2B illustrates a cutaway perspective view of an assembled first embodiment of the present invention utilizing a "stretcher" in conjunction with a typical gondola as one would encounter in a retail sales establishment. The cutaway portion shows the interoperability of the various components.
Figure 3A:
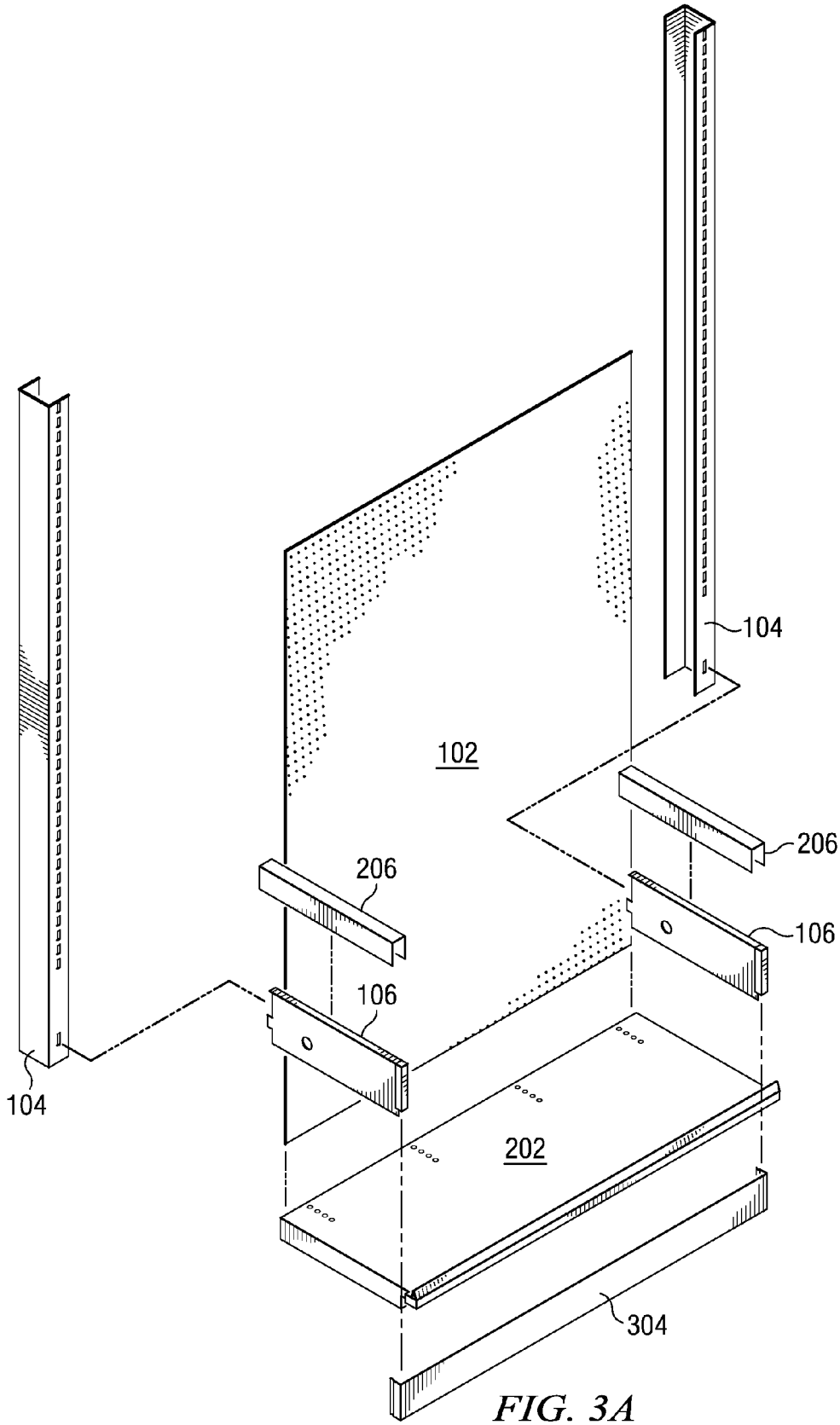
FIG. 3A illustrates an exploded perspective view of a second embodiment of the present invention utilizing a "spanner" in conjunction with a typical gondola unit.
Figure 3B:
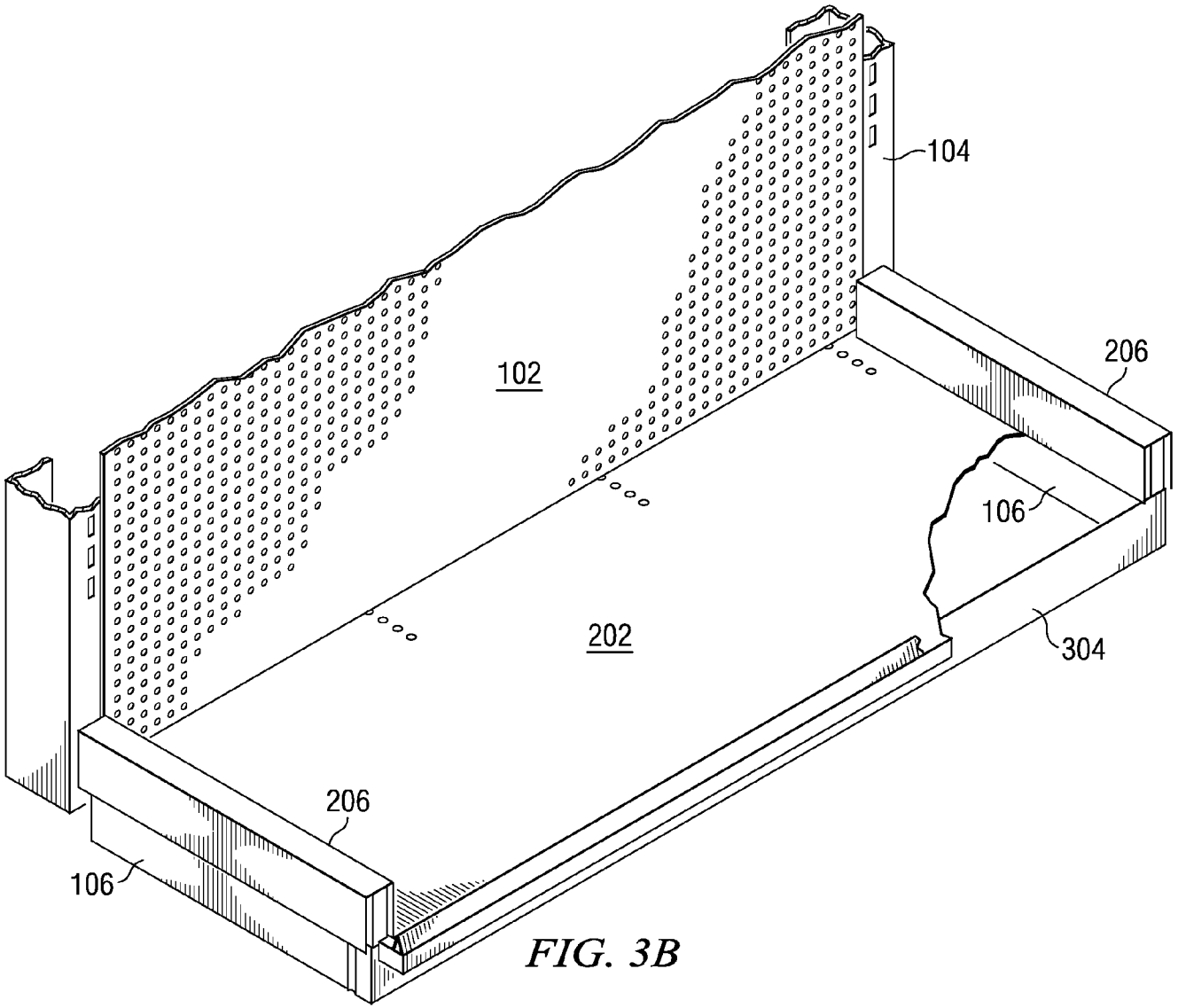
FIG. 3B illustrates a cutaway perspective view of an assembled second embodiment of the present invention utilizing a "spanner" in conjunction with a typical gondola as one would encounter in a retail sales establishment. The cutaway portion shows the interoperability of the various components.

Referring now to the provided drawings, similar reference numerals represent the equivalent component throughout the several views of the drawings. FIG. 2A shows an exploded perspective view of a first embodiment of the present invention while FIG. 2B shows a cutaway portion of a typical assembled gondola unit modified by the first embodiment of the present invention. FIG. 3A shows an exploded perspective view of a second embodiment of the present invention while FIG. 3B shows the respective cutaway portion of the second embodiment modified by the present invention. The present invention comprises a free-standing base deck 202 (shown in FIGS. 2 and 3) that serves as a direct replacement for the original base deck 114 (shown in FIG. 1) of the prior art gondola unit.

Because the original base deck 114 is normally directly attached to the back panel 102 and both base brackets 106 and possibly the base front 116, removal of the original base deck 114 and base front 116 requires a spacing device for maintaining the parallel alignment of the base brackets 106. In the first embodiment as illustrated in FIG. 2, the spacing device chosen is a stretcher 204 while in FIG. 3, which shows a second embodiment, a different spacing device known as a spanner 304 is chosen.

With respect to FIG. 2, to maintain proper base bracket 106 alignment, the ends of the stretcher 204 removably attach to the forward most ends of the respective base bracket 106 thus ensuring the base brackets 106 remain fixed in a parallel fashion. The stretcher 204 also restores overall rigidity to the gondola unit that is lost due to the removal of the original base deck 114 and base front 116, and maintains the overall structural integrity of the gondola with regards to the gondola's load bearing capability.

FIG. 3 shows a second embodiment that uses a spanner 304 that serves in the same capacity as the stretcher 204. The spanner 304 and stretcher 204 (shown in FIG. 2) both demonstrate that a different spacing device can be chosen without departing from the inventive concept. It is even possible, on some gondola units, to leave the base front 116 in place. However, removal of the original base deck 114 and installation of the free-standing base deck 202 will result in a lower shelf for the gondola unit having increased vertical space (due to the use of the improvement) but being "walled-in" by the still existing base front 116. Thus, it may be more aesthetically pleasing to remove the base front 116 and install either a stretcher 204 or a spanner 304 in its place.

In FIG. 2 the free-standing base deck 202 takes the place of the original base deck 114 by occupying the space between the back panel 102, base brackets 106 and stretcher 204, with no physical attachments to any portion of the gondola. The free-standing base deck 202 thus positionally registers itself between the back panel 102, base brackets 106 and stretcher 204. By sitting on the floor beneath the gondola, the free-standing base deck 202 thus reclaims the retail shelving space that is the difference between the height of the original base bracket 114 from the floor and the height of the free-standing base bracket 202 from the floor. In the embodiment shown, the free-standing base deck 202 is approximately 3 inches in height. The original base deck 114 of a representative gondola unit is approximately 6 inches or greater from the top of the base deck to the floor. Thus, the present invention can reclaim as much as 3 inches or more in additional shelving height over the unmodified gondola unit. This additional space translates into increased retail shelving space for display and sales of a greater quantity of retail product per modified gondola.

Once the original base deck 114 is removed, portions of the base brackets 106 may become exposed. Consequently, a concealing device for restoring and maintaining the aesthetic qualities of the gondola unit is required. The concealing device chosen in both the first embodiment of FIG. 2 and second embodiment of FIG. 3 is a leg cap 206. This leg cap 206 replaces the base bracket trim 118 and effectively covers any exposed portions of the base bracket 106.

In the embodiment shown in FIG. 2, the free-standing base deck 202 and leg caps 206 are constructed from metal, preferably 18 Ga. cold rolled steel. This material is commonly used in the display shelving industry and thus should not require retooling or special machinery to manufacture. It is also durable and relatively inexpensive to use compared to other metals. In addition, this material is easily bent or folded using a metal brake and can also be welded. Thus, the free-standing base deck 202 and leg caps 206 can be manufactured using the same or similar process used to manufacture the other components of a standard gondola unit. Because there is no significant retooling required to manufacture the preferred embodiment of the present invention, manufacturing costs can be kept to a minimum. Alternative materials, such as plastic or fiberglass, can also be used in the construction of the free-standing base deck 202 and leg caps 206. Material selection can be based on the particular needs of the existing gondola unit.

The free-standing base deck 202 can be manufactured to essentially any width/depth/height combination depending on the requirements of the base deck 114 that it is replacing. In the embodiment shown in FIG. 2, the free-standing base deck 202 measures approximately 46¾ inches in width by approximately 23½ inches in depth by approximately 3 inches in height. It is formed from three pieces of 18 Ga. cold rolled steel; one piece for the base deck top surface and one piece for each of the two sides. One method for manufacturing this embodiment would be to take a single sheet of the preferred material, cut to the preferred dimensions with approximately 4½ inches added to the depth in order to form the front and back edges. The front edge could be formed by bending approximately 1½ inches of the depth dimension downward using a metal brake such that the finished edge forms an angle of approximately 105 degrees with the bottom surface of the base deck material. In a similar fashion, the rear edge of the base deck could be formed by bending approximately 3 inches of the depth dimension downward using a metal brake such that the finished edge forms an angle of 90 degrees with the bottom surface of the base deck material. The dimension of this rear edge establishes the height that the completed free-standing base deck top surface maintains from the floor. The two sides of the base deck can then be formed from pieces of the same preferred material, cut to the profile of the previously formed free-standing base deck with formed front and back edges. These two side pieces can then be welded into place (using any welding process suitable for the material being used) on the respective sides of the free-standing base deck 202, thus completing its construction.

The embodiments shown in FIGS. 2 and 3 each utilize a free-standing base deck 202 with a raised lip on its front edge to provide positive retention of items placed on the top surface. This lip runs the width of the free-standing base deck 202 and has a triangular shaped cross section. It is also possible to use a free-standing base deck 202 without the lip or else with a traditional wire-framed fence as is commonly used in display shelving. To accommodate a traditional wire-framed fence, the free-standing base deck 202 can have suitable perforations in its top surface to accept the fence's mating tabs. The free-standing base deck 202 shown in the provided drawings has perforations in its top surface near the rear edge to illustrate this. With minor modifications, any display shelving product retention means is possible without straying from the inventive concept.

The leg cap 206 can be manufactured using the same process and materials as the free-standing base deck, and can be essentially any width/depth/height combination as well. Because the leg cap 206 is meant as a decorative cover to replace the displaced base bracket trim 118, the width/depth/height combination of any leg cap 206 should be chosen to hide any exposed surfaces of the original gondola base bracket 106. This is aesthetically necessary because the free-standing base deck 202 exposes the inner surfaces of the original base bracket 106 that were once hidden by the now displaced original base deck 102. Each leg cap 206 can be manufactured from a single sheet of the same or similar material used for the free-standing base deck 202 by bending the two longest sides downward to form a channel that is sufficiently wide enough to slip over the top of a base bracket 106. The end of the leg cap 206 that would be opposite the upright 104 could then be closed by welding an appropriate sized rectangular piece of the same or similar material over the opening of the channel. The finished leg cap 206 should be sufficiently wide enough to fit over a base bracket 106; sufficiently long enough to cover the length of the base bracket 106; and sufficiently tall enough to cover the vertical height of the exposed portions of the base bracket 106.

The stretcher 204 in the preferred embodiment of FIG. 2 is constructed from metal, preferably 16 Ga. cold rolled steel. Likewise, in FIG. 3, the spanner 304 is constructed of the same material. Heavier materials can be used for the stretcher 204 or spanner 304 because it adds to the structural integrity of the gondola on which it is installed. The stretcher 204 in the first embodiment is comprised of three components formed from three pieces of the chosen material. One component measures approximately 46⅞ inches in length by 1½ inches in width. The piece can be bent on a metal brake such that it forms a "U" shaped channel along the length; the bottom of the channel measuring approximately ¾ inches in width and the two sides of the channel measuring approximately ½ inch in height. Thus, this first piece of the stretcher 204 establishes the width of the space between the two parallel base brackets 106 upon which the stretcher 204 will eventually attach. The other two components that comprise the stretcher 204 are the two upright pieces that provide the physical attachment with the base bracket 106. These upright pieces can be made from two identical pieces of the same material as the first piece of the stretcher, measuring approximately 4 inches in length by approximately 1⅔ inches in width. The upright pieces in the first embodiment are formed into a "J" shape by bending them along their length such that the bottom and side of the "J" are approximately ½ inches long. To complete the stretcher 204, the two upright components are attached to the longer center component by welding. Thus, the completed stretcher 204 will provide a positive, physical attachment with each respective base bracket 106, maintaining the base brackets 106 parallel in order to allow adequate spacing and maintain alignment for the free-standing base deck 202. In addition, the stretcher 204 allows adequate spacing between itself and the back panel 102 to properly retain the free-standing base deck 202.

The spanner 304 in the second embodiment of FIGS. 3A and 3B is comprised of a single sheet of the same chosen material, which is bent in such a fashion to create the necessary rigidity and removably attachable end pieces to allow it to serve the same spacing device means as the stretcher 204. The ends of the spanner 304 are essentially "tabs" that are bent inward to create a feature similar to a standard spring clip that allows for the ends to attach to a particular gondola's base brackets 106. Thus, with minor modifications to the chosen spacing device means it is possible to adapt the spacing device to accommodate essentially any commercial gondola.

All of the dimensions provided for the two described embodiments can be easily varied in order to meet the needs of any particular gondola unit. While there are many standard sizes of commercial gondolas, there can be significant variations that would necessitate adjustments to the required dimensions. While specific embodiments of the invention have been disclosed, one of ordinary skill in the art will recognize that one can modify the dimensions and particulars of the embodiments without straying from the inventive concept.

We claim:

1. An improvement to a product display having a vertical back panel having two ends, a vertical upright attached to each end of said back panel, at least one base bracket attached to each of said vertical uprights in a perpendicular arrangement with said back panel, and a base front attached on each of its opposite ends to said base bracket in a parallel arrangement with the back panel, wherein the improvement comprises:

a free-standing base deck positioned within said back panel, said base brackets, and said base front, wherein said base deck is the bottom-most shelf of said product display which rests on the surface upon which said product display sits, wherein said base deck is not physically attached to said back panel, said base brackets, or said base front, and further wherein said base deck positionally registers with said back panel, said base brackets, said base front, and the surface upon which said product display sits wherein the base brackets extend above said free-standing base deck and further comprising a concealing device covering the portions of said base brackets which extend above said free-standing base deck to maintain an aesthetic appearance of said product display utilizing said free-standing base deck.

2. The improvement of claim 1 further comprising a spacing device which maintains said base brackets substantially parallel in place of said base front.

3. The improvement of claim 2 wherein said spacing device is a stretcher.

4. The improvement of claim 2 wherein said spacing device is a spanner.

5. The improvement of claim 2 wherein said spacing device is manufactured from metal.

6. The improvement of claim 2 wherein said spacing device is manufactured from plastic.

7. The improvement of claim 1 wherein said base brackets extend above said free-standing base deck and further comprising a concealing device covering the portions of said base brackets which extend above said free-standing base deck to maintain an aesthetic appearance of said product display utilizing said free-standing base deck.

8. The improvement of claim 7 wherein said concealing device is a leg cap.

9. The improvement of claim 7 wherein said concealing device is manufactured from metal.

10. The improvement of claim 7 wherein said concealing device is manufactured from plastic.

11. The improvement of claim 1 wherein said free-standing base deck is manufactured from metal.

12. The improvement of claim 1 wherein said free-standing base deck is manufactured from plastic.

* * * * *

UNITED STATES PATENT AND TRADEMARK OFFICE

CERTIFICATE OF CORRECTION

PATENT NO. : 7,886,919 B2
APPLICATION NO. : 11/419004
DATED : February 15, 2011
INVENTOR(S) : Joseph Marcus Battaglia, Jr. et al.

It is certified that error appears in the above-identified patent and that said Letters Patent is hereby corrected as shown below:

Language was incorrectly added to claim 1 that already exists in claim 7.

Column 6, line 64 to Column 7, line 2 delete "wherein the base brackets extend above said free-standing base deck and further comprising a concealing device covering the portions of said base brackets which extend above said free-standing base deck to maintain an aesthetic appearance of said product display utilizing said free-standing base deck"

Signed and Sealed this
Thirty-first Day of May, 2011

David J. Kappos

David J. Kappos
*Director of the United States Patent and Trademark Office*